US008550451B2

(12) United States Patent
Yoshida

(10) Patent No.: US 8,550,451 B2
(45) Date of Patent: Oct. 8, 2013

(54) IMAGE-FORMING APPARATUS AND PAPER CASSETTE USED THEREIN

(75) Inventor: Naoto Yoshida, Yokohama (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/569,585

(22) Filed: Aug. 8, 2012

(65) Prior Publication Data

US 2013/0038014 A1 Feb. 14, 2013

(30) Foreign Application Priority Data

Aug. 11, 2011 (JP) ..... 2011-176026

(51) Int. Cl.
*G03G 13/00* (2006.01)
*B65H 1/00* (2006.01)

(52) U.S. Cl.
USPC ..... 271/145; 399/107; 399/108

(58) Field of Classification Search
USPC ..... 271/145; 399/107, 108; 206/449
See application file for complete search history.

(56) References Cited

U.S. PATENT DOCUMENTS 5,737,667 A * 4/1998 Okuda et al. ..... 399/108
6,834,172 B2 * 12/2004 Tomita ..... 399/108
7,995,948 B2 * 8/2011 Yano et al. ..... 399/107
8,107,852 B2 * 1/2012 Ito ..... 399/110
8,139,977 B2 * 3/2012 Fukuda ..... 399/107
8,366,098 B2 * 2/2013 Kobayashi ..... 271/171
2007/0237541 A1 * 10/2007 Johnson et al. ..... 399/107
2011/0140352 A1 * 6/2011 Tanaka ..... 271/264
2012/0104683 A1 * 5/2012 Blair et al. ..... 271/121

FOREIGN PATENT DOCUMENTS

JP 2005-189752 A 7/2005
JP 2007-106034 A 4/2007

* cited by examiner

*Primary Examiner* — Kaitlin Joerger
(74) *Attorney, Agent, or Firm* — Holtz, Holtz, Goodman & Chick, PC

(57) ABSTRACT

An image-forming apparatus 1 has a paper cassette 3*b* therein. The paper cassette is installed into the apparatus along a guide channel 46 attached to a housing frame 45 of the apparatus. A housing 44 of the apparatus has a left side surface forming front and rear opening structures 9 at a lower portion. A hold 48 is provided on an inner-upper portion of the opening structure. The paper cassette has a left-side exterior portion 50 forming a recess 51 at a position facing the opening structure. A space 52 is prepared next to the recess without impairing the original function of the paper cassette. When moving the apparatus, a worker inserts his hand into the opening structures, touching the holds with his palms and flexes his fingers in the spaces, thereby firmly gripping the holds with his hand and lifting the printing apparatus in his arms.

8 Claims, 6 Drawing Sheets

IMAGE-FORMING APPARATUS AND PAPER CASSETTE USED THEREIN

CROSS-REFERENCE TO RELATED APPLICATION

The present application is based upon and claims the benefit of priority from the prior Japanese Patent Application No. 2011-176026, filed Aug. 11, 2011, the entire contents of which are incorporated herein by reference.

BACKGROUND OF THE INVENTION

1. Field of the Invention

The present invention relates to an image-forming apparatus and paper cassettes to be installed thereon. Requiring a small installation space, the image-forming apparatus is provided with a handle or hold to be gripped by a user to move the apparatus to other location.

2. Description of the Related Art

Comparatively small-sized image-forming apparatuses are known, which have a structure including a paper-cassette receiving unit in its lower portion for detachably receiving a paper cassette. For instance, these comparatively small-sized image-forming apparatuses are apparatuses having a size suitable for installing on an office desk.

In the case where the image-forming apparatus of this size is delivered form a factory to an office or when such image-forming apparatus is moved to another installation site, for example, two office workers cooperate in holding the handles provided on the both sides of the apparatus to carry it.

An image-forming apparatus is proposed in Unexamined Japanese Patent Application Kokai Publication No. 2005-189752, which apparatus effectively uses a space and is provided with handles simple in structure for firmly preventing hand-slipping when users move the apparatus to another installation place.

Unexamined Japanese Patent Application Kokai Publication No. 2007-106034 discloses an apparatus comprising an electronic device with an extension unit attached to its lower portion, wherein the extension unit has a safeguard for preventing the user from handling a grip of a housing of the extension unit, thereby preventing the user from dropping the electronic device on the floor when he or she tries to move the electronic device and the extension unit together by holding the extension unit.

In the image-forming apparatus disclosed by Unexamined Japanese Patent Application Kokai Publication No. 2005-189752, the front side and the rear side of the apparatus body are something like hollowed to provide hand-reach areas therein and the hand-reach areas allow the user to insert his or her hands to reach the grip.

In the image-forming apparatus, various sorts of interior devices and members are mounted inside the position where the hand-reach area is provided. Accordingly, it is required to prepare a space for mounting a structure of the grip at a position outward and separate from these interior devices and members or between these interior devices and members to avoid interference of the grip structure with these interior devices and members.

In the case where the space for mounting the grip structure is prepared at the position outward and separate from these interior devices and members, the body of the image-forming apparatus could become large in size. Further, in the case where the space for mounting the grip structure is prepared between these interior devices and members, the grip structure could be set at a position hard for the user to reach and a machine design will receive a limitation. In the image-forming apparatus disclosed in Unexamined Japanese Patent Application Kokai Publication No. 2005-189752, no concept of space saving can be found.

Further, in the electronic device with an extension unit attached to, disclosed by Unexamined Japanese Patent Application Kokai Publication No. 2007-106034, the grip to be used by the user for moving electronic apparatuses is proposed, but the user is force to move the electronic device and the extension unit separately, when using such grip. In the electronic device disclosed in Unexamined Japanese Patent Application Kokai Publication No. 2005-189752, no special concept of space saving can be found.

In recent, it is generally perceived that not only the image forming apparatuses but also the electronic apparatuses used at offices, requiring a smaller installation space are more preferable. Meanwhile, the electronic apparatuses are required to have an opening structure for the grip, which is deep enough, allowing the user to firmly hold the apparatus.

But, the opening structure for the hold could be a factor, which makes the body of the apparatus large in size, and meanwhile, such opening structure provides no useful function at other times. Under the circumstance, there is one requirement of providing an opening structure for the hold that is simple in structure, giving no limitation to the design of the apparatus and that makes the body of apparatus as small as possible in size.

SUMMARY OF THE INVENTION

The present invention meets the above requirement and provides an image-forming apparatus and paper cassettes used therein, which apparatus is provided with an opening structure to be gripped by a user to carry the image-forming apparatus to other location. The opening structure is shared between the body of the apparatus and an interior member of the apparatus, whereby making the installation space of the apparatus as small as possible.

According to one aspect of the invention, there is provided an image-forming apparatus, comprising a body, a hand-held portion provided on a side surface of the body, to be gripped by a user when the apparatus is moved to other location, and a paper cassette for containing papers, detachably received in the body, the paper cassette having a side wall formed with a hand-held recess, wherein the hand-held portion is provided at a apposition on the side surface of the body, facing the hand-held recess formed in the side wall of the paper cassette, when the paper cassette is received in the body.

According to another aspect of the invention, in the above image-forming apparatus, the side surface of the body is composed of an exterior cover and a side frame, and the hand-held portion is composed of the exterior cover forming a hand-holding opening and the side frame having a bent portion corresponding to the hand-holding opening formed in the exterior cover.

According to still another aspect of the invention, in the above image-forming apparatus, the body is provided with a receiving portion for receiving the paper cassette detachably at a lower position of the body, and the side surface of the body where the hand-held portion is provided is the side of the lower position of the body, and further the paper cassette is installed on and/or removed from the receiving portion of the body in the horizontal direction.

According to other aspect of the invention, the above image-forming apparatus further comprises a paper conveying unit for conveying papers contained in the paper cassette in a paper-conveying direction perpendicular to the direction in which the paper cassette is installed in and/or removed from the receiving portion of the body, and wherein the hand-held portion is provided on the side surface of the body and rearwards in the paper-conveying direction, and the hand-held portions are provided on the side surface of the body at two positions, and a hold may be provided on other side surface of the body, which hold is different from the hand-held portion and is used together with the hand-held portion when the body is moved. Further, it is preferable that the hand-held portions are integrally provided on body.

According to yet another aspect of the invention, there is provided a paper cassette for containing papers, used in an image-forming apparatus provided with a hand-held portion on a side surface of a body of the apparatus, wherein the hand-held portion is held by a user when the body is moved to other location and the paper cassette is detachably installed into the body, which paper cassette has a portion forming a hand-held recess at a position facing the hand-held portion provided on the side surface of the body, when the paper cassette is installed into the body.

According to still another aspect of the invention, in the above paper cassette, the body of the image-forming apparatus is provided with a receiving portion for receiving the paper cassette detachably at a lower position of the body, and the side surface of the body where the hand-held portion is provided is the side of the lower position of the body, and the paper cassette is installed on and/or removed from the receiving portion of the body in the horizontal direction.

According to still other aspect of the invention, in the above paper cassette, the hand-held recess of the paper cassette is a space extensive from a cutout to an inside of the paper cassette, wherein the cutout is formed in a side wall of the paper cassette on a rear side in a paper-conveying direction in which the paper contained in the paper cassette is conveyed.

According to yet other aspect of the invention, the paper cassette comprises a paper limiting member for limiting rear edges of the papers contained in the paper cassette in a paper-conveying direction, in which the paper in the paper cassette is conveyed, wherein the paper limiting member is extensible in the paper-conveyed direction, and wherein the hand-held recess of the paper cassette is formed in the vicinity of a disengaging position where the paper limiting member stays when papers of the maximum size are contained in the paper cassette, and the hand-held recesses are formed in the paper cassette at two positions on both sides of the disengaging position of the paper limiting member and in the direction perpendicular to the paper-conveying direction.

In the image-forming apparatus and the paper cassettes used together with the apparatus, according to the embodiments of the invention, the portion of the opening structure (hand hole) to be gripped by a user with his or her hand for moving the printing apparatus is shared between the body of the printing apparatus and the interior member to be installed on the printing apparatus. Accordingly, a space-saving printing apparatus including paper cassettes can be obtained according to the embodiments of the invention.

BRIEF DESCRIPTION OF THE DRAWINGS

A more complete understanding of the present invention will be obtained when the following detailed description is read in conjunction with the following drawings, in which.

DETAILED DESCRIPTION OF THE PREFERRED EMBODIMENTS

Now, the embodiments of the present invention will be described in detail with reference to the accompanying drawings.

First Embodiment

Figure 1:
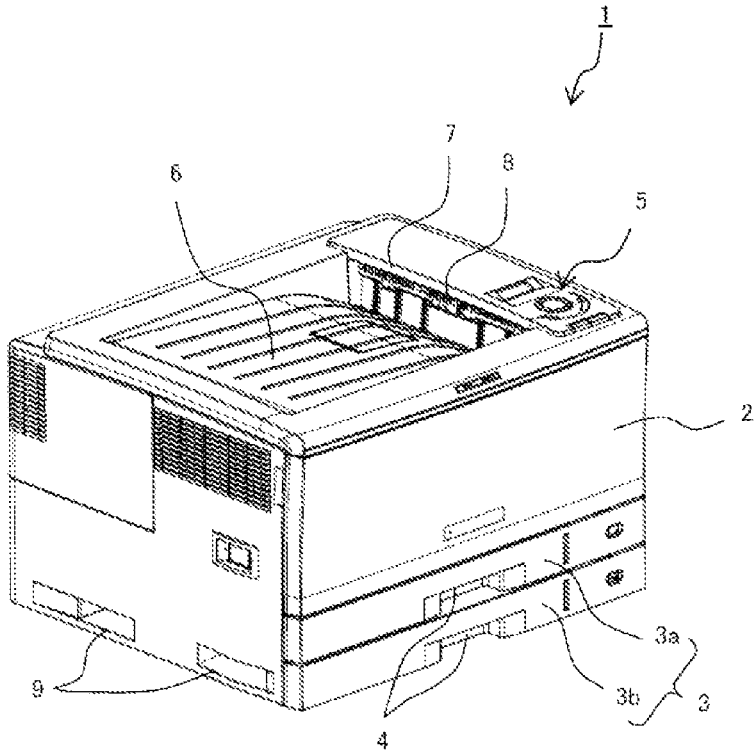
FIG. 1 is an external perspective view illustrating a full-color image-forming apparatus (printing apparatus) according the first embodiment of the invention, which apparatus is provided with opening structures to be used when said apparatus is moved to other location.

FIG. 1 is an external perspective view illustrating a full-color image-forming apparatus (printing apparatus) according the first embodiment of the invention. As shown in FIG. 1, the printing apparatus 1 has opening structures (hand holes) on its side surface, which opening structures are conveniently used by a user when the user holds and moves the printing apparatus 1 to other place. Further, the printing apparatus 1 is provided with a front door 2 and is mounted with two paper cassettes 3 (3*a*, 3*b*) on the lower side of the front door 2, as shown in FIG. 1.

The two paper cassettes have handles or knobs 4, respectively. The user of the printing apparatus 1 uses the handle 4 of the paper cassette 4 to remove and/or install the paper cassette 3 from/onto the body of the printing apparatus 1 along guide rails provided inside the body of the apparatus 1 in the front direction of the printing apparatus 1, as will be described in detail.

The printing apparatus 1 has an operation panel 5 on its top right surface, and is provided on its top with a paper ejecting section 6 for ejecting image-forming media ("image-forming papers" or simply "papers").

The operation panel 5 is composed of a key operation section including plural keys (not shown with reference numbers) and a liquid crystal display device for displaying information sent from a controlling section (not shown).

On the right side of the paper ejecting section 6, as viewed in FIG. 1, there is provided a paper ejecting opening 7. Further, there is provided a paper ejecting roller 8 in the paper ejecting opening 7. The paper ejecting roller 8 serves to successively eject and pile on the paper ejecting section 6 papers delivered from an image-forming unit. The image-forming unit serves to form a color image on a paper, which unit will be described in detail later.

On the lower portion of the left side surface of the printing apparatus 1, two opening structures (hand holes) 9, 9 are provided side by side, which are used to be held or gripped by the user when the printing apparatus 1 is moved to other place. The opening structure (hand hole) 9 will be described in detail, later.

Figure 2:
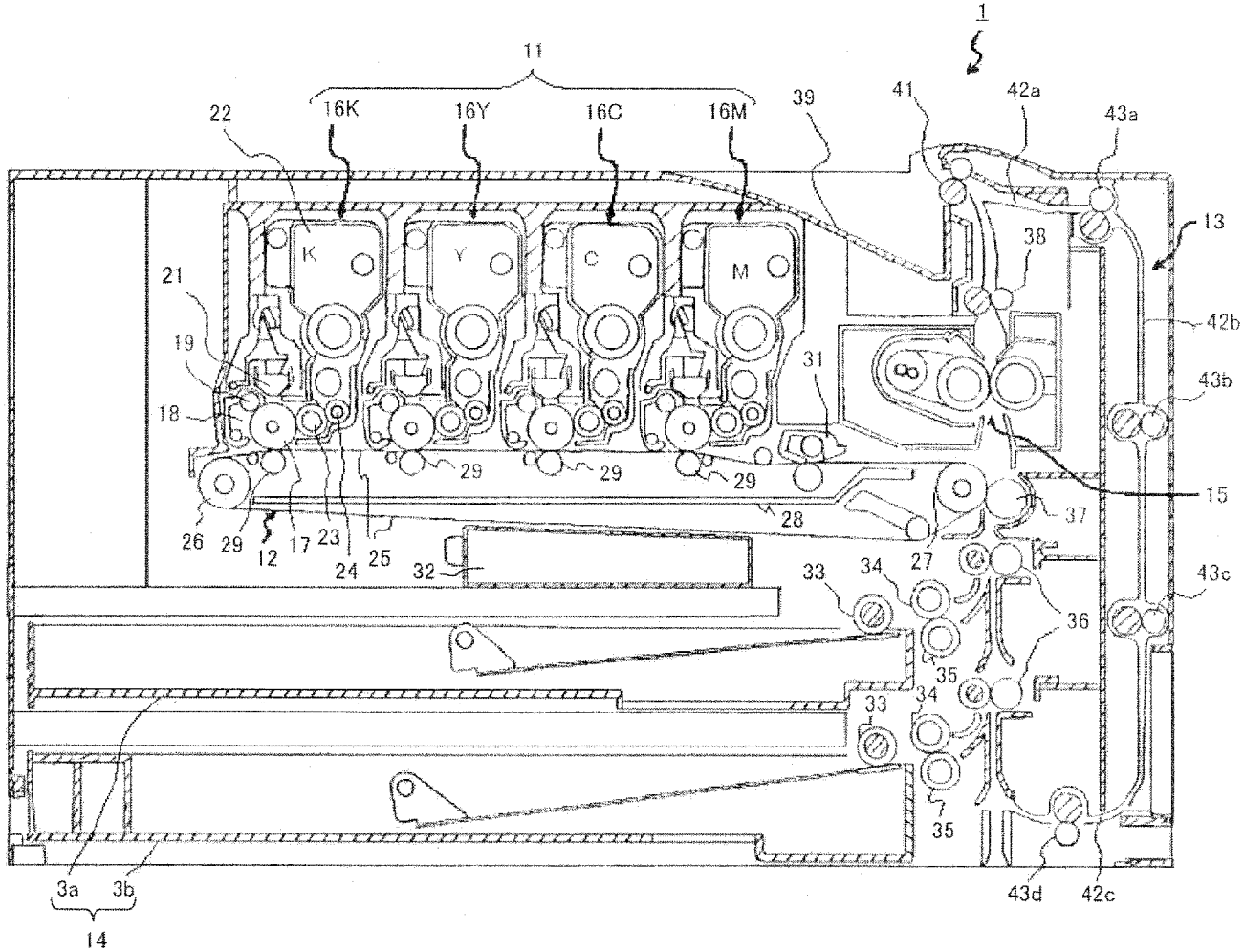
FIG. 2 is a sectional view for explaining an internal configuration of the printing apparatus according to the first embodiment of the invention.

FIG. 2 is a sectional view for explaining an internal configuration of the printing apparatus 1 according to the first embodiment of the invention. As shown in FIG. 2, the printing apparatus 1 comprises an image-forming section 11, a belt unit 12, a double-side printing conveyance unit 13, a paper feeding section 14 and a fixing section 15.

The image-forming section 11 comprises four image-forming units 16 (16M, 16C, 16Y and 16K), which are disposed in a multi stage fashion from the right to the left, as shown in FIG. 2. The image-forming unit 16K serves to form a mono-chrome image, using black toner (K), which is mainly used for representing characters and black portions in images.

The three image-forming units 16M, 16C and 16Y in the upstream of the image-forming section 11 serve to form mono-color images of the three primary colors, using Magenta (M) toner, Cyan (C) toner, and Yellow (Y) toner, respectively.

Each of the image-forming units 16 has the same configuration except the color of the toner contained in a toner container (toner cartridge). Hereinafter, taking the image-forming unit 16K using the black toner (K) for example, the configuration thereof will be described.

The image-forming unit 16 is provided with a photoreceptor drum 17 at its bottom portion. The photoreceptor drum 17 has an outer periphery, for instance, of an organic photoconductor material.

In contact with or in the vicinity of the outer periphery of the photoreceptor drum 17, there are arranged a cleaner 18, a charging roller 19, an optical writing head 21 and a developing roller 23 of a developing device 22 so as to surround the photoreceptor drum 17.

The developing device 22 contains either of Magenta (M) toner, Cyan (C) toner, Yellow (Y) toner or Black (K) toner in its toner container held at the upper portion, and has a toner feeding mechanism at the middle portion to feed the toner toward the bottom.

Further, the image-forming unit 16 is provided with the above described developing roller 23 at a side opening beneath the developing device 22, and further has an internally mounted toner mixing member, toner feeding roller 24 and a doctor blade, wherein the toner feeding roller 24 serves to feed the toner to the developing roller 23 and the doctor blade serves to adjust a toner layer on the developing roller 23 to a predetermined constant depth.

The belt unit 12 comprises an endless transferring belt 25, a driving roller 26 and a driven roller 27, wherein the transferring belt 25 is provided substantially in the middle portion of the printing apparatus 1 from the left end to the right end as viewed in FIG. 2 and forming substantially a flattened loop as viewed from the side, and the driving roller 26 drives the transferring belt 25 in the counter clockwise direction.

The transferring belt 25 directly receives a toner image on its belt surface (primary transfer) and conveys the toner image to a transferring position where the toner image is transferred onto a paper (secondary transfer) (hereinafter, the whole belt unit 12 is referred to as an "intermediate transferring belt unit".)

The belt unit 12 is provided with a belt-position controlling mechanism 28 within the flattened loop formed by the transferring belt 25. The belt-position controlling mechanism 28 has primary transferring rollers 29, which are made of a conductive formed-sponge and are depressed onto the outer surfaces of the photoreceptor drums 17 through the transferring belt 25, respectively.

The belt-position controlling mechanism 28 drives to rotate the three primary transferring rollers 29 about hook-like supporting shafts at the same period, wherein the three rollers 29 correspond to the three image-forming units 16M for Magenta (M), 16C for Cyan (C), and 16Y for Yellow (Y), respectively.

Meanwhile, the belt-position controlling mechanism 28 drives to rotate the one primary transferring rollers 29 corresponding to the image-forming unit 16K for Black (K) at a period different from the above three transferring rollers 29, thereby separating the transferring belt 25 from the photoreceptor drum 17.

In other words, the belt-position controlling mechanism 28 sets a position of the transferring belt 25 of the belt unit 12 depending on the operation mode, in which the printing apparatus 1 has been set. The printing apparatus 1 has three operation modes, that is, a full-color mode, a monochrome mode, and a whole non-transferring mode. In the full-color mode, all the four primary transferring rollers 29 are kept in contact with the transferring belt 25. In the monochrome mode, only the primary transferring rollers 29 corresponding to the image-forming unit 16K is kept in contact with the transferring belt 25. In the whole non-transferring mode, all the four primary transferring rollers 29 are kept separate from the transferring belt 25.

Further, the belt unit 12 has a belt cleaning section 31 placed at an upper stream of the image-forming unit 16M, which is placed at the most upstream position in the moving direction of the upper surface of the transferring belt 25. The belt unit 12 also has a detachable flattened waste-toner recovery container 32, which is held in contact with the lower portion of the belt unit 12.

The belt cleaning section 31 is connected to the waste-toner recovery container 32 through an interim storage, a waste-toner conveying screw and a dropping tube (not shown).

The paper feeding section 14 comprises two paper cassettes 3 (3*a*, 3*b*), one being piled on top of another, as shown in FIG. 1. In the vicinity of the paper feeding openings of the two paper cassettes 3*a*, 3*b*, there are provided paper take-up rollers 33, paper-sending rollers 34, paper-handling rollers 35, and stand-by conveying paired-rollers 36.

In the paper conveying direction (in the vertical direction as viewed in FIG. 2), in which a paper is conveyed by the stand-by conveying paired-rollers 36, there is provided a secondary transferring roller 37, which is pressed against the driven roller 27 with the transferring belt 25 held there between. The transferring belt 25, the driven roller 27 and the secondary transferring roller 37 operate together to compose a secondary transferring section for transferring an image onto a paper.

In the down stream side of the secondary transferring section (the upper side as viewed in FIG. 2), there is provided the fixing section 15 composed of a heat fixing unit of a belt type. Further, in the down stream side of the fixing section 15, there are provided discharging paired-rollers 38 for taking up a paper from the fixing section 15 and paper ejecting paired-rollers 41 for ejecting the paper onto a paper ejecting tray 39 formed on the top surface of the printing apparatus 1.

The double-side printing conveyance unit 13 has an outer surface (a right side cover as viewed in FIG. 2), which serves as an access cover of the printing apparatus 1. The double-side printing conveyance unit 13 provides a return path separating to the right (as viewed in FIG. 2) from a halfway point in a paper-conveying path between the discharging paired-rollers 38 and the paper ejecting paired-rollers 41.

The return path is composed of a starting return path 42*a*, an intermediate return path 42*b* and a finishing return path 42*c*, wherein the intermediate return path 42*b* turns off downwards and the finishing return path 42*c* turns off leftwards, finally turning over the paper. The return path is provided with four sets of return paired-rollers 43*a*, 43*b*, 43*c* and 43*d*, respectively at halfway points of the return paths 42*a*, 42*b*, and 42*c*.

The outlet port of the finishing return path 42*c* leads towards the paper-conveying path to the stand-by conveying paired-rollers 36.

As shown in FIG. 2, the printing apparatus 1 does not employ a system, in which the image-forming unit 16 directly transcribes a toner image onto a paper, but employs a system, in which a toner image is transcribed onto a paper via the transferring belt 25 (secondary transferring system), which paper is conveyed vertically to the secondary transferring section by the stand-by conveying paired-rollers 36.

As described above, since troubles such as paper jams are hard to arise in the assembly of the various elements (kits) of the printing apparatus 1, for a replacing or removing purpose of consumable supplies and material such as the kits, which are assembled to concentrate to the left side as viewed in FIG. 2, the printing apparatus 1 is constructed such that the user is simply required to perform operation of removing or replacing these kits in the front-back direction with the front door 2 shown in FIG. 1 open.

In the printing apparatus 1, spaces between the kits are saved as possible and the whole body of the printing apparatus 1 is down-sized and in particular, the width of the printing apparatus 1 is made reduced. Further, the optical writing head its self is also reduced in size, and the optical writing head and photoreceptor drum 17 are arranged in the close vicinity to each other.

The printing apparatus 1 according to the first embodiment of the invention is further downsized in width, which will be described hereinafter.

Figure 3:
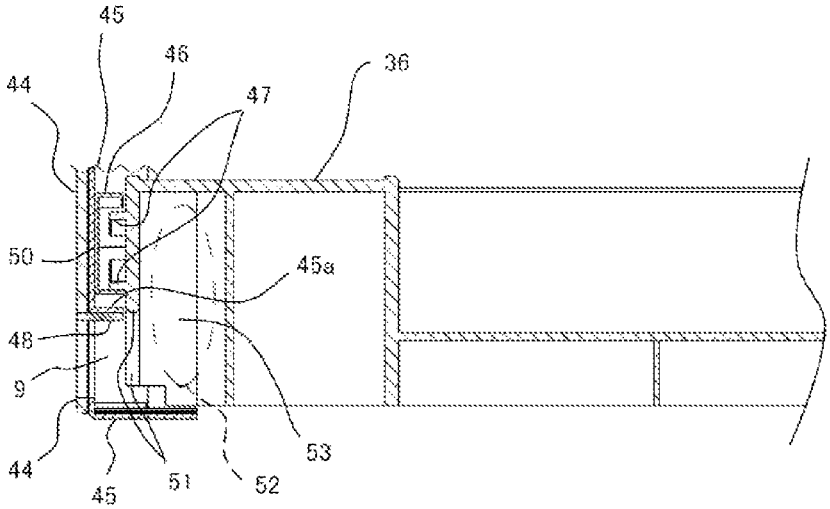
FIG. 3 is a view illustrating the left corner of a paper cassette in the lower tier of two paper cassettes shown in FIG. 1 and FIG. 2, and the left corner of the body of the printing apparatus according to the first embodiment of the invention.

FIG. 3 is a view illustrating the left corner of the paper cassette 3*b* in the lower tier of two paper cassettes shown in FIG. 1 and FIG. 2, and the left corner of the body of the printing apparatus 1.

A housing 44 of the printing apparatus 1 is shown in FIG. 3, and a housing frame 45 is formed in close contact with an inner surface of the housing 44. In the bottom corner of the printing apparatus 1, the opening structure (hand hole) 9 (shown in FIG. 1) is provided integrally with the body of the apparatus 1.

As shown in FIG. 3, the lowest portion of the housing frame 45 is bent inward at a right angle to form an overhang 45*a*, and a hold or handle (hereinafter, "hold") 48 is formed on an inner surface of the opening structure (hand hole) 9 in close contact with the lower surface of the overhang 45*a*.

A guide channel 46 forming a recess is attached to the internal surface of the housing frame 45 in the upper portion of the opening structure (hand hole) 9. The guide channel 46 engages with engaging rails 47 of the paper cassette 3*b*.

The paper cassette 3*b* has a left-side exterior portion 50 forming a cutout 51, which faces the opening structures (hand hole) 9, 9 of the printing apparatus 1, when the paper cassette 3*b* is installed in the body of the printing apparatus 1. The cutout 51 is made in the left-side exterior portion 50 on the lower side of the two engaging rails 47 and extends both sides (front and rear side) of a central portion (as viewed from the top), which faces a position where a paper left-edge limiting member takes when said member stays at the most left end. This paper left-edge limiting member will be described later.

As will be described in more detail later, a space 52 next to the cutout 51 (a space on the right side of the cutout 51 as viewed in FIG. 3) is provided in an area between a front and a rear exterior portion and a left-side central interior portion 53, that is, the paper left-edge limiting member (hereinafter, sometimes referred to as a "lengthwise-edge limiting member") which stays at the most left end.

When moving the printing apparatus 1, a worker inserts his or her hand into the opening structure (hand hole) 9 of the printing apparatus 1 to touch the hold 48 with his or her palm and further inserts his or her hand into the space 52 through the cutout 51 to flex his or her fingers in the space 52, thereby firmly gripping the hold 48 with his or her hand and lifting the body of the printing apparatus 1 in his or her arms.

Figure 4:
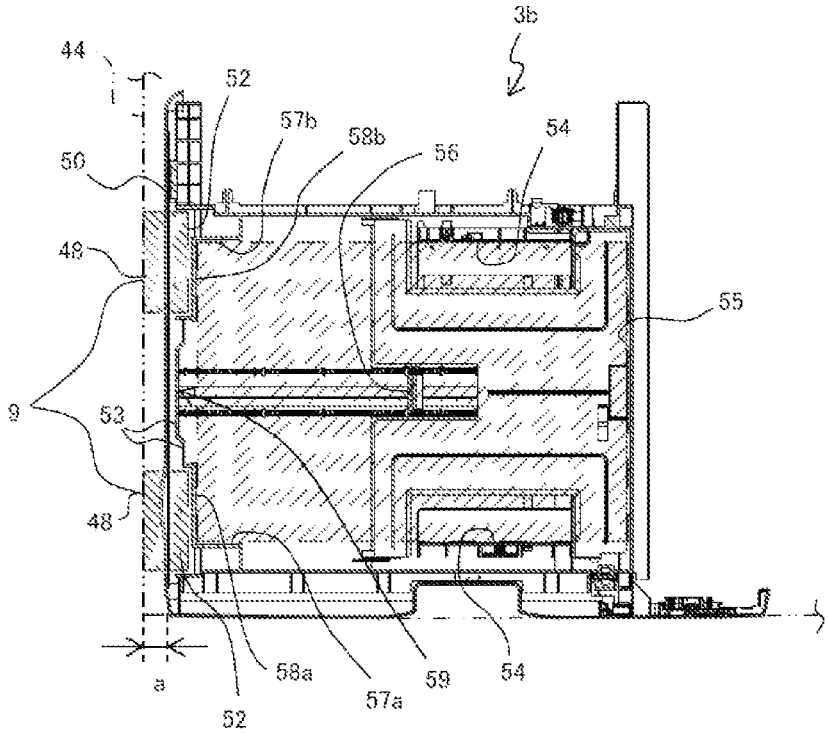
FIG. 4 is a horizontal cross-sectional view of the paper cassette in the lower tier, in which an outer ward of a housing of the printing apparatus is virtually shown by a two-dot chain line and an outline of a portion of an opening structure (hand hole) to be held or gripped by a user is also virtually shown in hatching.

FIG. 4 is a horizontal cross-sectional view of the paper cassette 3*b*, in which the outer ward of the housing 44 of the printing apparatus 1 is virtually shown by a two-dot chain line and the outline of the portion of the opening structure (hand hole) 9 to be gripped by the worker is also virtually shown in hatching.

The cross-sectional view of FIG. 4 is taken along the line lower than the guide channel 46 attached to the housing frame 45 of the printing apparatus 1 and the engaging rail 47 of the paper cassette 3*b*, and therefore, the guide channel 46 and the engaging rail 47 cannot be seen in FIG. 4. A paper containing space of the paper cassette 3*b* has a paper size, which can convey A3 papers in its longitudinal direction, wherein A3 papers are of the maximum paper size in the present example.

When papers such as B4 papers, A4 papers, B5 papers, etc., smaller in size than A3 papers are refilled in the paper cassette 3*b*, two paper-side limiting members 54, 54 are set to limit the position of the papers. The two paper-side limiting members 54, 54 are provided on the right side of the paper cassette 3*b*, as viewed in FIG. 4, and serve to limit the paper position in the direction perpendicular to the paper conveying direction.

Further, the paper position is limited in the paper conveying direction both by the internal surface of a right-side interior portion 55 of the paper cassette 3*b* and by the paper left-edge limiting member (lengthwise-edge limiting member) 56. In other words, the front edges of the papers to be conveyed are limited by the internal surface of the right-side interior portion 55 of the paper cassette 3*b* and the rear edges of the papers are limited by the lengthwise-edge limiting member 56.

The lengthwise-edge limiting member 56 takes a position shown in FIG. 4 to limit the rear edges of A4 papers, when A4 papers are refilled in the paper cassette 3*b* to be conveyed sideways.

When A3 papers, which are available maximum size in the printing apparatus 1 are refilled in the paper cassette 3*b*, both sides of the papers in their front portion are limited by both paper-side limiting members 54, 54 provided on the right portion of the paper cassette 3*b* and both sides of the papers in their rear portion are limited by a front internal panel 57*a* and a rear internal panel 57*b* provided on the left end of the paper cassette 3*b*.

The position of the front ends of the available maximum size papers, A3 papers are limited by the internal surface of the right-side interior portion 55 of the paper cassette 3*b*, and the position of the rear ends of the papers are limited by the internal surfaces of left-side interior portions 58*a*, 58*b* of the paper cassette 3*b*.

When the available maximum size papers, A3 papers are refilled in the paper cassette 3*b*, the lengthwise-edge limiting member 56 moves to a place 59 for disengagement, which place is provided at the left-side central position of the paper cassette 3*b* by the left-side central interior portion 53 of the paper cassette 3*b*.

The left-side central interior portion 53 provides the place for the lengthwise-edge limiting member 56 to stay for disengagement, which place locates behind the rear ends of A3 papers (the left end in FIG. 4) whose positions are limited by the left-side interior portions 58*a*, 58*b*, and therefore, the left-side central interior portion 53 is the most left end interior portion of the paper cassette 3*b*.

Since the left-side central interior portion 53 provides the place 59, where the lengthwise-edge limiting member 56 stays for disengagement, when the available maximum size papers are refilled in the paper cassette 3*b*, the left-side central interior portion 53 composes an essential element of the paper cassette 3*b*, and requires a small space for the lengthwise-edge limiting member 56 to stay but needs not so much large space.

Therefore, spaces 52, 52 are provided between the exterior portion and the interior portion on both sides of the left-side central interior portion 53. These spaces 52, 52 do not impair a primary paper-feeding function of the paper cassette 3*b*. The spaces 52, 52 are connected to the opening structure (hand hole) 9 through the cutout 51 provided on the exterior portion shown in FIG. 3.

As described above, in the printing apparatus 1 according to the first embodiment of the invention, the portion of the opening structure (hand hole) 9 to be gripped by the user with his or her hand for moving the printing apparatus 1 is shared among the hold 48 of the printing apparatus 1 and the spaces 52 provided by the interior member, that is, the paper cassette 3*b*.

Originally, the portion (the hold 48 and the spaces 52) of the opening structure 9 to be gripped by the user with his or her hand, is to be placed on the further leftward side of the left-side exterior portion 50 of the paper cassette 3*b*, but about half of the portion is placed in the spaces 52 provided in the paper cassette 3*b* in the present printing apparatus 1. Accordingly, the printing apparatus 1 can be downsized in width to that amount.

In other words, a distance "a" between the left-side exterior portion 50 of the paper cassette 3*b* and the housing 44 of the printing apparatus 1 will be about half of the portion (the hold 48 and the spaces 52) of the opening structure 9 to be gripped by the user.

Figure 5:
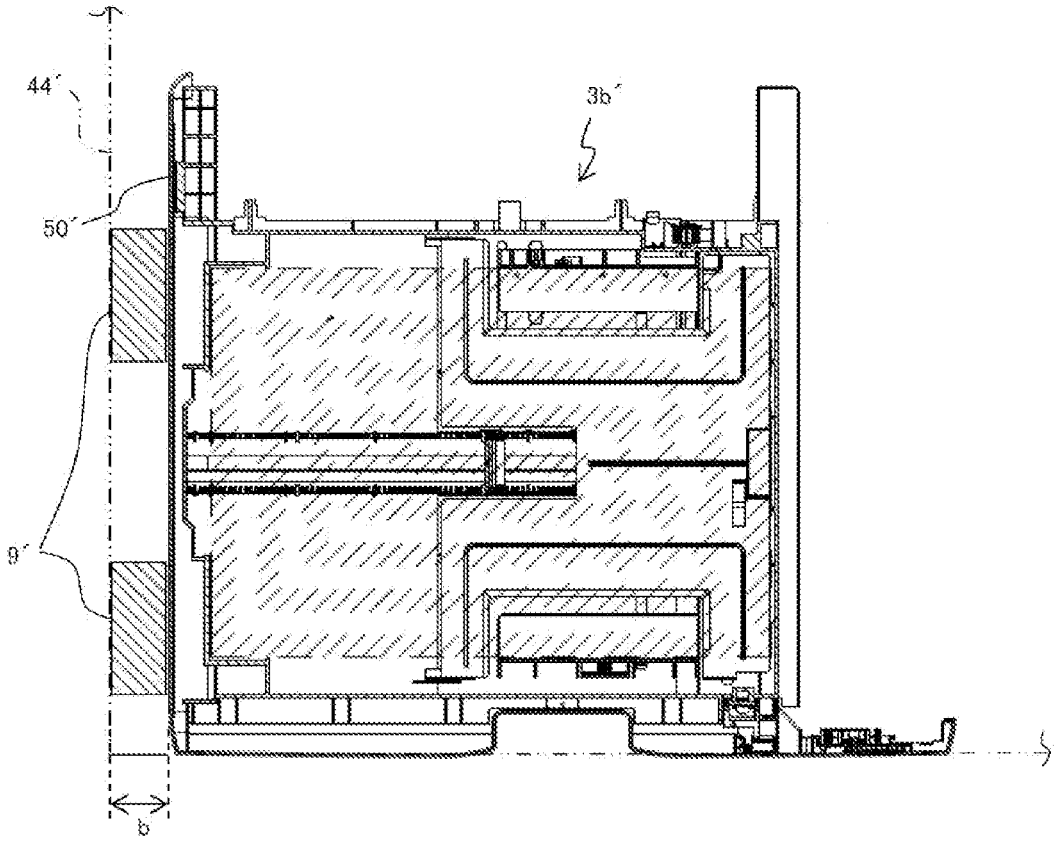
FIG.5 (PRIOR ART)
FIG. 5 is a cross-sectional view showing a prior art (conventional paper cassette), in which an outer ward of a housing of a printing apparatus is virtually shown by a two-dot chain line and an outline of a portion of an opening structure (hand hole) to be held or gripped by the user is also virtually shown in hatching.

FIG. 5 is a cross-sectional view showing a prior art (conventional paper cassette), in which the outer ward of a housing of a conventional printing apparatus is virtually shown by a two-dot chain line and an outline of a portion of an opening structure (hand hole) to be gripped by the user is also virtually shown in hatching. The cross-sectional view of FIG. 5 is prepared for comparing the prior art with the printing apparatus 1 according to the first embodiment of the present invention.

In the conventional printing apparatus shown in FIG. 5, a distance "b" between the left-side exterior portion 50' of the paper cassette 3*b*' and the housing 44' of the printing apparatus needs substantially the same distance as the hatched portion of the opening structure 9' to be gripped by the user. The distance "b" shown in FIG. 5 is about twice as large of the distance "a" shown in FIG. 4.

Second Embodiment

Figure 6:
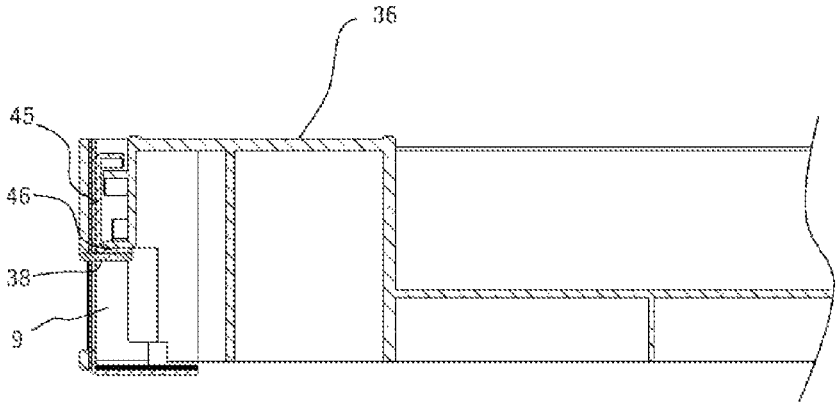
FIG. 6 is a cross-sectional view showing a left-side portion of the paper cassette installed in the printing apparatus according to the second embodiment of the invention and a left-side portion of said printing apparatus.

FIG. 6 is a cross-sectional view showing the left-side portion of the paper cassette mounted in the printing apparatus according to the second embodiment of the invention and the left-side portion of said printing apparatus. In the first embodiment, the lowest portion of the vertical housing frame 45 is bent at a right angle to form the overhang, to which the hold 48 is fixed.

In the second embodiment shown in FIG. 6, the lowest portion of the vertical housing frame 45 is not bent but instead the guide channel 46 forming a recess is arranged so as to meet the upper portion of the opening structure (hand hole) 9. The hold 48 is fixed onto a lower part of the guide channel 46.

In the embodiments of the invention, as described above, the portion of the opening structure (hand hole) to be gripped by the user with his or her hand for moving the printing apparatus is shared between the body of the printing apparatus and the interior member to be mounted on the printing apparatus. Accordingly, a space-saving printing apparatus including paper cassettes can be realized according to the embodiments of the invention.

Having described and illustrated the principles of the present application by reference to the preferred embodiments, it should be apparent that the preferred embodiments may be modified in arrangement and detail without departing from the principles disclosed herein and that it is intended that the application be construed as including all such modifications and variations insofar as they come within the sprit and scope of the subject matter disclosed herein.

What is claimed is:

1. An image-forming apparatus, comprising:

a body;

a hand-held portion provided on a side surface of the body, to be gripped by a user when the apparatus is moved to another location; and a paper cassette for containing papers, detachably received in the body, the paper cassette having a side wall formed with a hand-held recess, wherein the hand-held portion is provided at a apposition on the side surface of the body, facing the hand-held recess formed in the side wall of the paper cassette, when the paper cassette is received in the body, wherein the hand-held recess is accessible through the hand-held portion when the paper cassette is received in the body.

2. The image-forming apparatus according to claim 1, wherein the side surface of the body is composed of an exterior cover and a side frame; and the hand-held portion is composed of the exterior cover forming a hand-holding opening and the side frame having a bent portion corresponding to the hand-holding opening formed in the exterior cover.

3. The image-forming apparatus according to claim 1, wherein the body is provided with a receiving portion for receiving the paper cassette detachably at a lower position of the body; and the side surface of the body where the hand-held portion is provided is the side of the lower position of the body.

4. The image-forming apparatus according to claim 3, wherein the paper cassette is installed on and/or removed from the receiving portion of the body in the horizontal direction.

5. The image-forming apparatus according to claim 1, further comprising:

a paper conveying unit for conveying papers contained in the paper cassette in a paper-conveying direction perpendicular to the direction in which the paper cassette is installed in and/or removed from the receiving portion of the body, and wherein the hand-held portion is provided on the side surface of the body and rearwards in the paper-conveying direction.

6. The image-forming apparatus according to claims, wherein the hand-held portions are provided on the side surface of the body at two positions.

7. The image-forming apparatus according to claim 6, wherein the image-forming apparatus has a hold on other side surface of the body, wherein the hold is different from the hand-held portion and is used together with the hand-held portion when the apparatus is moved to other location.

8. The image-forming apparatus according to claim 1, wherein the hand-held portion is integrally formed with the body.

* * * * *

UNITED STATES PATENT AND TRADEMARK OFFICE

CERTIFICATE OF CORRECTION

PATENT NO. : 8,550,451 B2
APPLICATION NO. : 13/569585
DATED : October 8, 2013
INVENTOR(S) : Naoto Yoshida It is certified that error appears in the above-identified patent and that said Letters Patent is hereby corrected as shown below:

In the Claims

Column 11, Line 3 (Claim 6, Line 1):

delete "claims" and insert --claim 5--.

Signed and Sealed this
First Day of April, 2014

Michelle K. Lee

Michelle K. Lee
*Deputy Director of the United States Patent and Trademark Office*